US007427918B2

(12) United States Patent
Fano

(10) Patent No.: US 7,427,918 B2
(45) Date of Patent: Sep. 23, 2008

(54) CARGO SECURITY SENSING SYSTEM

(75) Inventor: Andrew E. Fano, Lincolnshire, IL (US)

(73) Assignee: Accenture GmbH, Schaffhausen (CH)

( * ) Notice: Subject to any disclaimer, the term of this patent is extended or adjusted under 35 U.S.C. 154(b) by 0 days.

(21) Appl. No.: 11/938,014

(22) Filed: Nov. 9, 2007

(65) Prior Publication Data

US 2008/0055075 A1 Mar. 6, 2008

Related U.S. Application Data

(63) Continuation of application No. 10/958,602, filed on Oct. 5, 2004, now abandoned.

(51) Int. Cl.
*G08B 13/00* (2006.01)

(52) U.S. Cl. ..... 340/541; 340/540; 340/572.1; 340/572.4; 340/572.8; 340/10.33; 340/5.9; 340/539.22; 340/539.26; 235/385; 235/492

(58) Field of Classification Search ..... 340/541, 340/540, 572.1, 572.4, 572.8, 10.33, 5.9, 340/539.22, 539.26, 552; 235/382, 492
See application file for complete search history.

(56) References Cited

U.S. PATENT DOCUMENTS 4,750,197 A 6/1988 Denekamp et al.
5,565,858 A * 10/1996 Guthrie ..... 340/10.33
5,615,247 A 3/1997 Mils et al.
5,831,531 A 11/1998 Tuttle et al.
7,005,985 B1 * 2/2006 Steeves ..... 340/572.1
2004/0056767 A1 3/2004 Porter
2005/0162270 A1 * 7/2005 Lambright et al. ..... 340/539.1
2006/0164239 A1 * 7/2006 Loda ..... 340/539.22

FOREIGN PATENT DOCUMENTS

FR 2787904 6/2000

* cited by examiner

*Primary Examiner*—Tai T Nguyen
(74) *Attorney, Agent, or Firm*—Vedder Price PC

(57) ABSTRACT

A cargo security sensing system includes a smart container having a sensor, wherein the smart container is a standard shipping cargo container that includes the sensor. The sensor may be any suitable type of sensing device capable of sensing changes in environmental conditions. The sensing system includes a plurality of dumb containers in corresponding relation to the smart container, wherein, the dumb container may be any suitable shipment container, including the same type of cargo shipment container or other type, as the smart container, excluding the sensor. The system for cargo security provides for the smart container to detect an event occurring with respect to either the smart container itself and/or the nearby dumb containers. An event may be an occurrence detected by the sensor, such that the smart container may notify of any potential security breaches in any of the containers.

15 Claims, 4 Drawing Sheets

CARGO SECURITY SENSING SYSTEM

CROSS-REFERENCE TO RELATED APPLICATIONS

The instant application is a continuation of U.S. patent application Ser. No. 10/958,602, entitled "CARGO SECURITY SENSING SYSTEM" filed Oct. 5, 2004, now abandoned, the entirety of which is incorporated herein by this reference.

FIELD OF THE INVENTION

The present invention relates generally to a security system for shipping containers and more specifically to the sensing of possible security breaches in one or more cargo containers within a network of cargo containers.

BACKGROUND OF THE INVENTION

Concurrent with the growth of the global economy, the volume of shipments of goods has increased. Many international shipments are transported using ships to transport a large number of cargo containers. These cargo containers are transported in large volumes from points of origin to intermediate storage locations and to subsequent ports of entry.

When the cargo container arrives at a port of entry, concerns arise regarding security of the cargo containers. The security includes not only the security of the containers themselves, but also if the containers have been tampered with during shipment. For example, if a cargo container is breached by someone seeking to cause damage, a potentially dangerous item may be placed within the cargo container. Due to the sheer volume of cargo containers shipped annually, there exists a significant chance this threat could be undetected.

It is also noted that significant amounts of international shipping and domestic shipping occurs using other media. For example, a large number of cargo containers enter the country across railroads and semi-trailers. Furthermore, national shipping is typically done using the railroads and semi-trailer shipments over interstate highways.

For example, in the United States, there are approximately 102 seaports and the volume of shipments through these seaports has more than doubled since 1995. In 2001, the United States Customs processed approximately 214,000 vessels carrying subsequently approximately 5.7 million cargo containers. Globally, over 200 million cargo containers move between various seaports per year. In the United States alone, approximately 16 million cargo containers arrived within the United States by ship, truck and railroad within United States' 301 ports of entry in 2001.

While visual inspections may be performed generally on incoming shipments, it is unreasonable to inspect every single incoming cargo container. Furthermore, the cargo containers currently do not contain devices for detecting if a breach of the cargo container occurs. Moreover, due to the sheer volume of cargo containers currently utilized in global shipping, it is unreasonable to retrofit all cargo containers with sensing equipment.

As it is any time during the transportation of the cargo containers that security breaches may occur, it is unrealistic to maintain surveillance on all cargo containers during all points of shipment. Therefore, there exists a need for a system to monitor the security of cargo containers and providing sensing of potential or actual security breaches.

BRIEF DESCRIPTION OF THE DRAWINGS

The invention will be more readily understood with reference to the following drawings, wherein.

DETAILED DESCRIPTION OF THE DRAWINGS

Figure 1:
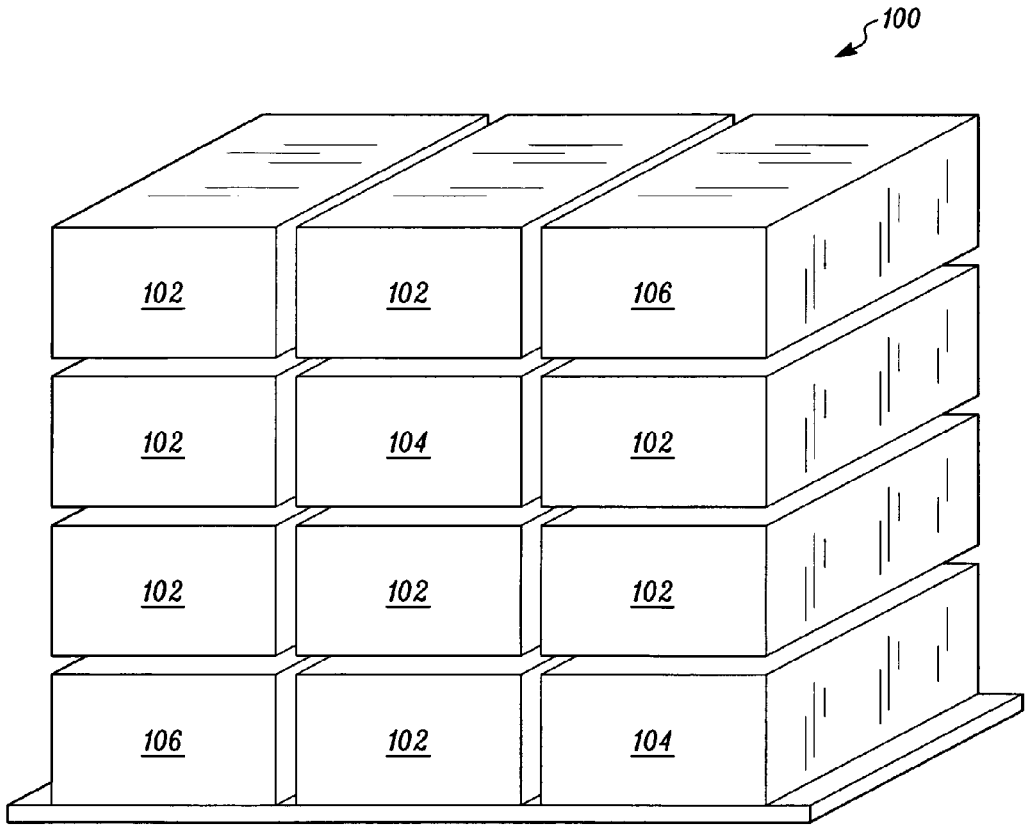
FIG. 1. illustrates a plurality of cargo shipping containers using the cargo security system of the present invention.

Briefly, the present invention includes a system for cargo security including a smart container having a sensor. The smart container may be any cargo container used for shipping, wherein the container includes at least some level of technology, such as the sensor and/or other electronic and communication components, as discussed below. Moreover, the smart container may include the element(s) installed on the container itself or the container may be deemed a smart container based on the disposition of element(s) being stored therein, such as a parcel, as discussed below. The sensor may be any suitable type of sensing device capable of sensing changes in environmental conditions. One example of a sensor may be an audio sensor capable of detecting a particular sound.

The present invention further includes a plurality of dumb containers in corresponding relation to the smart container. The corresponding relation may include, but not limited to, the dumb containers being stacked on top of, beneath, next to, or diagonal with the smart container. The dumb container may be any suitable shipment container, including the same type of cargo shipment container as the smart container, excluding the sensor. In other words, the dumb containers may be the smart containers without the sensor and associated electronic equipment. Moreover, different containers may have different degrees of instrumentation. That is, different instrumented containers may be equipped with sensors capable of sensing different threats. Similarly, different containers may have varying degrees of communications capabilities ranging from none, through passive RFID, active RFID tags, mesh networks, various short range wireless technologies, cellular and pager networks, and satellite communications among other technologies. In other words, the terms "smart" and "dumb" refer to ends on a spectrum of instrumentation rather than two levels of instrumentation.

The system for cargo security provides for the smart container to detect an event occurring with respect to either the smart container itself and/or the nearby dumb containers. An event may be an occurrence detected by the sensor. In the example of a noise sensor, if a loud sound occurs, such as the opening of a cargo container door, the noise sensor detects the event and generates an event indicator. The event indicator may include information for notification of the occurring event.

Therefore, the present invention allows for the detecting of a questionable event that may be indicative of a security breach. The present invention utilizes a smart container relative to multiple dumb containers such that cargo security may be obtained for a large volume of cargo containers using a limited number of modified containers. As noted above, most current cargo containers qualify as dumb containers, therefore the inclusion of several smart containers within an existing shipping cargo structure achieves cargo security without requiring modification of all existing cargo containers or the generation of new cargo containers. The present invention provides further benefits and improvements in cargo security, as discussed in further detail below.

More specifically, FIG. 1 illustrates a plurality of cargo shipping containers 100. The containers 100 are stacked upon each other, as typically found when placed on a ship for water-based transport. The assembly of the containers 100 may also effectively represent a common storage organization when the containers 100 are stored in a port or other location awaiting further transport. For example, the containers 100 may be stacked as shown in FIG. 1 when unloaded from a ship and awaiting further transport via railroad or trailer.

As discussed in further detail below, the containers 100 may include dumb containers 102, smart containers 104 and dumb but tagged containers 106. The dumb containers 102 may be any normal shipping container not including sensor elements found within the smart containers 104 and the dumb but tagged containers 106.

The smart containers 104, as discussed in further detail below with regards to FIG. 2, include a sensor for detecting environmental occurrences. In one embodiment, the smart containers 104 further include a radio frequency identifier (RFID) tag. The smart containers 104 include further elements beyond the dumb containers 102 and therefore the assembly of containers 100 may include several smart containers 104 interspersed with dumb containers 102.

The dumb but tagged containers 106 provide for intermediate functionality between the dumb containers 102 and the smart containers 104. The dumb but tagged containers 106 include electronics for an RFID tag. These containers 106 include some electronics, but do not include the sensor technology within the smart containers 104. Therefore, a typical assembly of containers 100 should include a majority of dumb containers 102 and several smart containers 104 and several dumb but tagged containers 106.

Figure 2:
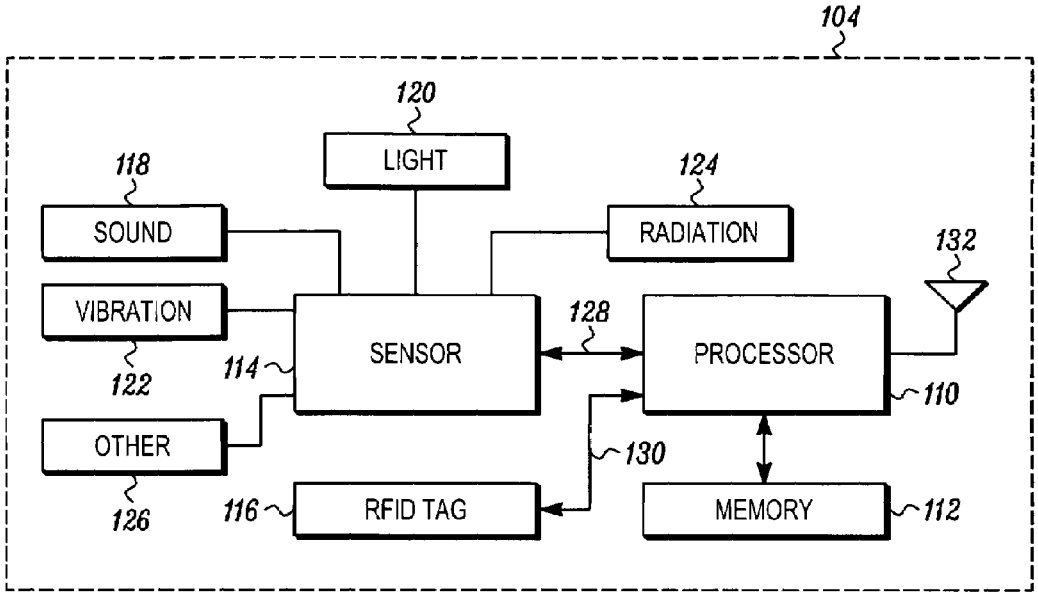
FIG. 2 illustrates a block diagram of a portion of a smart container in accordance with one embodiment of the present invention.

FIG. 2 illustrates one embodiment of a smart container 104 including a processor 110, a memory 112, a sensor 114 and an RFID tag 116. The processor 110 may be any suitable processor capable of processing executable instructions and performing processing operations as described herein. Moreover, the memory 112 may be any suitable memory device capable of storing executable instructions such that the processor 110 is operative to perform the processing operations in response to executable instructions.

The sensor 114 is represented generally in FIG. 2, but further includes specific sensing devices. The sensor 114 includes standard sensing technology but in varying embodiments of the present invention, the sensor may further include sensors operative to detect environmental factors in different media. For example, different sensors may include an audio sensor 118, a light sensor 120, a vibration sensor 122, a radiation sensor 124 or any other suitable type of sensor 126 as recognized by one having ordinary skill in the art. The sensors 118-126 operate in accordance with known and/or standard sensor and sensing techniques.

When the sensor 114, in one embodiment by virtue of the sensors 118-126, detects an event, the sensor 114 may either generate an event indicator 128 or may provide an indicator to the processor 110 such that the processor 110 may generate the event indicator. The event that is detected may be any suitable environmental event, such as a detecting a sound with the audio sensor 118, detecting light with the light sensor 120, detecting vibration with the vibration sensor 122 and/or detecting radiation or other chemical exposure with the radiation detector 124. The event indicator may be any suitable indicator of the event, including a data field having specific information relating to the event, such as but not limited to, type of event, time of event, strength of event (for example decibel level of an audio event), smart container information relating to the smart container 104 within which the sensor 114 is disposed, tag information relating to the RFID tag of the smart container 102 or any other suitable information as recognized by one having ordinary skill in the art.

In the present invention, as discussed in further detail below, the sensor 114, including sensors 118-126 are operative to detect environmental changes not only within the specific smart container 104, but also is operative to detect an event occurring within neighboring cargo containers, including dumb containers 102 and the dumb but tagged containers 106. Therefore, the smart container 104 is operative to report on events not specifically limited to the smart container 104 itself and therefore can provide a sensing system for a variety of cargo containers without requiring all containers to be smart containers.

Further illustrated in FIG. 2, the smart container 102 further includes, in one embodiment, the RFID tag 116. The RFID tag 116 operates in accordance with standard RFID tag technology, including storing identification information and operative to receive and transmit identification information. In one embodiment, the RFID tag 116 is in operative communication with the processor 110 for communication of identification data 130 from the RFID tag 116 and updating information from the processor 110.

The processor 110 further includes an antenna 132 such that the processor 110 may act as a wireless receiver and a transmitter. In one embodiment, the processor 110 may wirelessly transmit the event information. In another embodiment, the processor 110 may wirelessly receive tag information that is provided to the RFID tag 116.

The processor 110 may also receive event information from another smart container such that the processor 110 may re-transmit the event indicator. Thereupon, a plurality of smart containers 102 may generate a mesh network based on the ability to receive and transmit information therebetween. The plurality of smart containers 102 may also generate an ad hoc network based operative communication with each other. The mesh network may provide for a degree of redundancy to insure transmission of the event indicator. Whereas, the ad hoc network may provide for a data communication path based on any available smart container to retransmit the data.

In conjunction with the sensing system, a device or system may be further implemented to receive the event indicator. Using a network, a lower power transmitter may be utilized to transmit a short-distance wireless transmission. Any suitable wireless technique may utilized, such as but not limited to an IEEE 802.11x or Bluetooth wireless technique.

In other embodiments, more powerful transmission systems may be implemented. For example, a medium power transmission system may utilize a cellular transmission to a cellular receiving system. The transmission may utilize any suitable transmission technique available for cellular transmission. In another embodiment, the transmission system may be a terrestrial transmission system, such as broadcasting to a satellite receiver. Regardless of the specific transmission approach, the smart container 104 allows for the detection of an event, the generation of an event indicator and the transmission of the event indicator.

In another embodiment of the present invention, the sensing and communications elements of the smart container 104 may be disposed within a parcel. A stand alone parcel may be utilized to provide the smart container functionality without requiring specific manufacturing modifications to the cargo container. For example, the sensor 114, the RFID tag 116, the processor 110 and the memory 112 may be disposed in the parcel such that the parcel is then included within a previously deemed dumb container 102. In this embodiment, the security benefits of a smart container may be realized using a parcel. Furthermore, the parcel may be used in conjunction with normal shipping patterns to provide added levels of security or may be included in specific shipping routes to detect possible patterns of events, or in response to perceived or expected threats.

Figure 3:
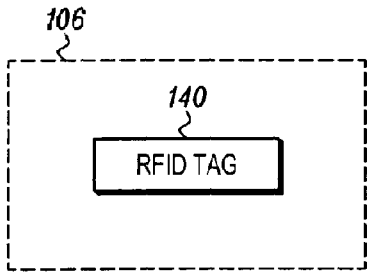
FIG. 3 illustrates a block diagram of a dumb but tagged container in accordance with one embodiment of the present invention.

FIG. 3 illustrates one embodiment of a dumb but tagged container 106. The dumb but tagged container 106 does not include the sensor technology as found within the smart container 104 of FIG. 2. The dumb but tagged container 106 does include an RFID tag 140. The RFID tag 140, similar to the RFID tag 116 of FIG. 2, operates in accordance with standard RFID tag techniques. The RFID tag 140 is operative to receive tag information and also operative to transmit the tag information in accordance with standard RFID technology.

In one embodiment, RFID tag writers may be disposed at specific locations to transmit tag information for storage within the RFID tag 140. For example, time and location information may be stored in the RFID tag 140. In another example, specific information regarding the location of a dumb but tagged container 106 relative to an assembly of cargo containers (such as 100 illustrated in FIG. 1).

Figure 4:
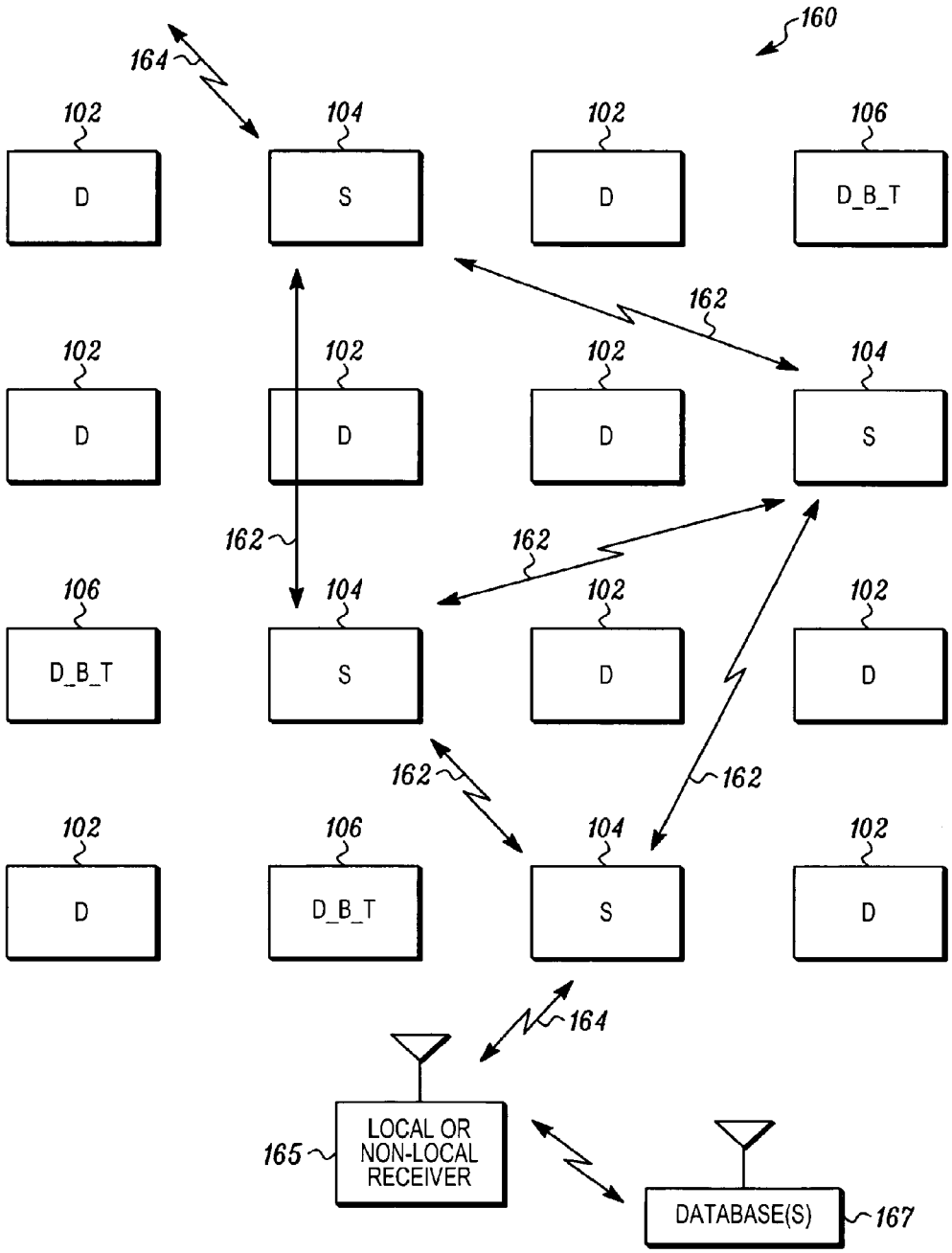
FIG. 4 illustrates a block diagram of cargo shipping containers in accordance with one embodiment of the present invention.

FIG. 4 illustrates an exemplary embodiment of multiple cargo containers 160 in a stacked arrangement. The arrangement includes dumb containers 102, smart containers 104 and dumb but tagged containers 106, wherein the orientation is a representative arrangement and other suitable arrangement of cargo containers 160 may provide the same cargo security system of the present invention. As noted in the assembly 160, the majority of the containers are dumb containers 102, which represent existing containers having no sensor technology included therein. Several smart containers 104 are interspersed with the dumb containers and several dumb but tagged containers 106 are also present.

Illustrated in FIG. 4, the smart containers 104 may be in communication 162 with each other for the generation of an ad hoc network or may be in communication in a defined mesh network established based on the disposition of smart containers 104 in the assembly 160. Moreover, the smart containers 104 may also generate transmission signals 164 for communication outside of the network of smart containers 104. For example, as discussed above, the transmission signals 164 may be transmitted to a local receiver, a cellular communication system, a terrestrial receiver or any other suitable receiver. A local or non-local receiver 165 may be in communication, through any suitable communication link, with one or more remote or local computer systems that include, for example, a database 167 (or databases) which may, for example, accumulate the electronic manifests that are associated with or downloadable from the container containers to identify, for example, the groups of dumb containers within a vicinity or shipping yard for example, that have recorded an event. The database 167 may be suitably analyzed by a computer or groups of computers if desired to, for example, sort the containers by the calculated threat level which would be a function of the number of threat detection events, as well as other information that may be reflected in the bill of lading or transport record, such as the sender and recipient, the stated contents, the degree of novelty of such a shipment, the path the shipment has taken, etc. The threat level data may then be recorded in the database and/or on the dumb container via any suitable RFID transmission or any other suitable communication and storage technology as previously described. As such, when the containers continue to pass through other security points, they can be identified as being a high threat container, medium threat container or low threat container, if desired, or any other suitable level. Each container will receive a treatment (such as inspect, type of inspection, pass, etc) depending on the calculated threat level. Moreover, the sorted list of containers may be used to identify the containers that should be inspected from a given set. For example, if on any given day 5% of containers will receive a particular type of inspection, this approach helps identify which 5% to inspect.

In addition, the containers that fall into, for example, a high threat level may be suitably quarantined at the vicinity or suitably transported or otherwise immediately evaluated to determine what may have caused the event to occur. The event information may serve to as data to increment, for example, a counter resident in the dumb container, or elsewhere to indicate the number of events, for example, that a dumb container has been associated with.

In addition, it will be recognized that the smart containers may also be suitably designated and monitored and the associated threat level data may also be stored in each of the containers and/or at a suitable database or series of databases. The database 167, for example, may be located at a centralized computer system or available through the Internet or suitable web server, or may be located at any suitable location or locations. The analysis and logging of the number of events, for example, may be accomplished through a suitable computer system wherein the computer system includes one or more processing devices that carry out the operations described herein by, for example, executing instructions that are stored in suitable memory. However, it will be recognized that any suitable structure may also be used.

The smart containers may also be requested to communicate the actual event information that has been recorded. For example, if the smart container includes, for example, a speech recorder, the centralized computer may send a suitable event detection request signal to the smart container and the smart container may then reply by sending the actual voice (e.g., the raw audible information) that has been recorded. A security officer may then listen to the exact sound that was recorded that caused an event detection. In this way, for example, if a human voice is the cause, the type of event can be further detected whereas if the sound came from thunder or other non-human source, this may also be considered relevant. As such, the downloading of the raw information that has been recorded by the smart container to a computer system (or device) can assist in providing improved security.

In addition, the threat level designated for a given dumb container is either stored on the container or at another suitable location and, for example, may be used to determine the threat level associated with a given location or position of the container. The central computer control system tracks the positioning of various cargo containers including dumb and smart containers as they are moving in any relevant area via GPS transmitter if they are on the containers or through the RFID tag readers. The central external control system may be a web-based system that is accessible through a suitable Internet connection and may combine one or more shipyards or any other suitable areas of interest and their associated smart and dumb containers. As such, any suitable granularity of monitoring may be facilitated depending upon the desired need.

The cargo containers 160 also allow for the dumb but tagged containers 106 to allow for further information in event information based on the RFID tag information. For example, if an event is detected, information from the RFID tag of a dumb but tagged container 106 may be used to help assess and locate the container or containers effected.

Figure 5:
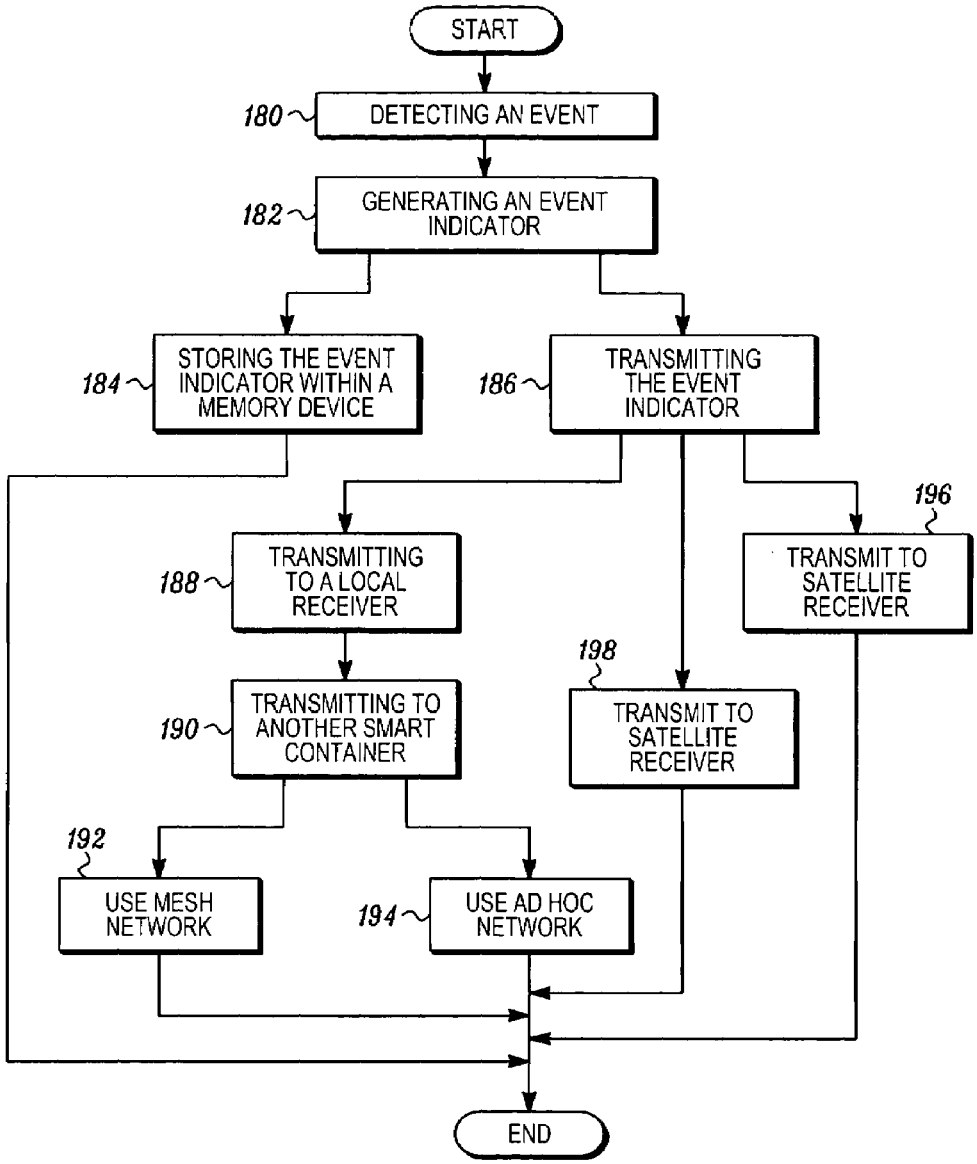
FIG. 5 illustrates a flow chart of method for cargo security in accordance with several embodiments of the present invention.

As discussed with further detail with respect to the flowchart of FIG. 5, the present invention allows for various levels of security based on usage of the event indicators. The method for cargo security begins with detecting an event using a sensor, step 180. The sensor is disposed within a smart container and is operative to detect an event occurring within any neighboring container, wherein neighboring containers include containers being within range for an event to be detected by the sensor. For example, if a sound is created by the opening of a door on a dumb container, all smart containers within distance of detecting the sound will detect the event, herein the generation of a sound.

The next step 182 is generating an event indicator. As discussed above, the event indicator is generated by the smart container. The event indicator 182 includes information relating to the detected event. For example, if a sound is detected, the event indicator may include data representing the detected volume or decibel level to provide an approximation of distance between the container subject to the event and the smart container detecting the event.

In one embodiment, the event indicator may be stored in a memory device, step 184. Any suitable memory may be utilized to store this information. Therefore, in this embodiment, a minimal level of security may be present including the detection of the event and the storage of the event indicator. With this level of security, the information may be retrieved at a later point in time to determine if an event has occurred.

In another embodiment, the method may further include transmitting the event indicator, as shown in step 186. In this level of security, the event indicator is transmitted to an outside source rather than being stored within the smart container. In one embodiment, the event indicator may be transmitted to a local receiver, step 188. The transmission to the local receiver may include transmitting to another smart container, step 190. In transmission to other smart containers, including reception and re-transmission by various smart containers, one embodiment includes transmitting within a mesh network, step 192, as discussed above. In another embodiment, the transmission may be within an ad hoc network, step 194, also as discussed above. Therefore, in another level of security, when an event occurs, notification of the event indicator is transmitted locally, such that a local receiver outside of the cargo containers may receive this information.

In another embodiment, the step of transmitting the event indicator (step 186) may further include transmitting the event indicator to a satellite receiver, step 196. This embodiment includes at least one smart container including a terrestrial transmitter.

Another embodiment includes using a cellular transmission of the event indicator (step 198). Similar to step 196, the event information may be transmitted outside of a local vicinity such that an increased level of security may exist based on the greater ability for notification. It is also within the present invention to include multiple options for notification including a terrestrial antenna or cellular antenna within a local network such that event indicators are transmitted to the terrestrial antenna across either an ad hoc or mesh network. Thereupon, in one embodiment of the present invention, the method for cargo security is complete.

The above discussion includes using a dumb but tagged container, such as container 106. In one embodiment, the present invention may utilize an external computer control system relating to the positioning of various cargo containers, including dumb and smart containers. For example, a database may include registration identifiers for all cargo containers within a shipyard or other vicinity. When an event is detected, the event information may be provided to an external system that monitors this information. The external computing system may cross-reference the registration identifiers for the cargo containers and update information regarding the detected event.

In the embodiments discussed above using an RFID tag, information may be readily stored within the RFID tag itself. Although, an external system may also provide the level of security through cargo registration identifiers and database management. It should also be noted that the external system does not have to be a local system since the smart containers may include high powered antenna systems for distributing data outside of a local cargo container storage area.

Based on the event information, external devices may allow for risk calculations. Any suitable technique may be utilized to assess a risk for a particular storage area and/or containers. In one embodiment, the risk may be assessed based on the number of events detected in the vicinity of a particular cargo container. For example, if an event is detected in a first shipyard, the cargo containers in that vicinity may be tagged with an incremental value. When the cargo containers move to different locations, the incremental value may be updated as a result of any events detected in the subsequent locations. In one embodiment, the incremental value may be maintained in a corresponding RFID tag. In another embodiment, the incremental value may be maintained in a database operating in conjunction with the detection systems and accessibility to cargo container registration identifiers.

Based on multiple increments and tracking of the increment value, visual inspection of a particular container may warranted. For example, if a container is in the vicinity of multiple events, the increment value is going to be incremented for each event. If the increment value is above a threshold amount, the container may be inspected. Other suitable techniques exist for determining the probability for maximizing further inspection requirements based on tracking the number of events that occur within a proximity of a particular cargo container.

As such, the present invention provides improved security for cargo containers based on smart container detection events, such as possible security breaches, within dumb containers. Using the smart containers, detecting of events further includes notifying external resources such as computer systems, for determining if the event warrants further inspections. Moreover, using multiple smart containers and possibly in connection with dumb but tagged containers, location of events may be detected. For example, if a radiation sensor detects a radiation level, multiple smart containers may allow for determining the location of the origination of the radiation based on the examination of measurements of the various smart container sensors.

Therefore, security is provided for existing cargo containers through the presence of smart containers and the outward-looking detection sensors of the smart containers, without requiring significant modification or up-grading of existing shipping container systems. Furthermore, the present invention allows for a greater degree of security in shipping yards and other transport areas without requiring physical systems upgrades. In shipyards having little to no technology, the present invention allows for security measures based on the outwardly looking smart containers and other systems for tracking cargo container information.

It should be understood that the implementation of other variations and modifications of the invention in its various aspects may be readily apparent to those of ordinary skill in the art, and that the invention is not limited by the specific embodiments described herein. For example, containers may further include receiver and transmitter technology, absent the sensor technology, for generation of improved mesh or ad hoc networks. It is therefore contemplated to cover, by the present invention any and all modifications, variations or equivalents that fall within the spirit and scope of the basic underlying principles disclosed and claimed herein.

What is claimed is:

1. A method for cargo security comprising:

detecting, by a plurality of smart containers each comprising at least one sensor for sensing environmental conditions and each in corresponding relation to a dumb container, at least one event for the dumb container;

associating the at least one event with the dumb container in at least one database; and determining by at least one computer in communication with the at least one database a threat level for the dumb container based on the at least one event detected by the plurality of smart containers, wherein the plurality of smart containers communicate with the at least one computer via at least one transmitter.

2. The method of claim 1, wherein detecting the at least one event further comprises detecting an event at a single location by the plurality of smart containers.

3. The method of claim 1, wherein detecting the at least one event further comprises detecting a first event at a first location by a first smart container of the plurality of smart containers and detecting a second event at a second location by a second smart container of the plurality of smart containers.

4. The method of claim 1, wherein associating the at least one event with the dumb container further comprises associating data indicative of the at least one event with an identification of the dumb container in at least one database.

5. The method of claim 1, wherein associating the at least one event with the dumb container further comprises storing data indicative of the at least one event on any of the plurality of smart containers and the dumb container.

6. The method of claim 1, wherein determining the threat level is based on a number of events associated with the dumb container.

7. The method of claim 1, further comprising:

associating data indicative of the threat level with an identification of the dumb container in at least one database.

8. The method of claim 1, further comprising:

storing data indicative of the threat level on any of the plurality of smart containers and the dumb container.

9. A system for cargo security comprising:

a plurality of smart containers, each smart container including a sensor for sensing environmental conditions;

a plurality of dumb containers in corresponding relation to the plurality of smart containers such that, for each of the plurality of smart containers, the sensor is operative to detect at least one event from a dumb container of the plurality of dumb containers;

at least one storage device, in communication with the plurality of smart containers, operative to store data indicative of the at least one event detected by the plurality of smart containers for the dumb container; and a computer system in communication with the plurality of smart containers and the at least one storage device operable to determine a threat level for the dumb container based on the at least one event detected by the plurality of smart containers, wherein the plurality of smart containers communicate with the computer via at least one transmitter.

10. The system of claim 9, wherein the computer system determines the threat level based on a number of events associated with the dumb container.

11. The system of claim 9, wherein the at least one storage device comprises a database in communication with the computer system.

12. The system of claim 9, wherein the dumb container comprises the at least one storage device.

13. The system of claim 12, wherein the at least one storage device comprises a radio frequency identification (RFID) tag associated with the dumb container, and wherein the plurality of smart containers communicate with the RFID tag via at least one transmitter.

14. A computer-readable medium having stored thereon a data structure comprising:

an identification of a dumb container that is in corresponding relation to a plurality of smart containers, each smart container of the plurality of smart containers including a sensor for sensing environmental conditions and operable to detect at least one event for the dumb container;

data, associated with the identification of the dumb container, indicative of the at least one event detected by the plurality of smart containers; and a threat level, associated with the identification of the dumb container, the threat level determined by at least one computer, in communication with the plurality of smart containers via at least one transmitter, based on the at least one event detected by the plurality of smart containers.

15. The computer-readable medium of claim 14, wherein the threat level is determined based on a number of events associated with the dumb container.

* * * * *